US005252019A

United States Patent [19]

Saunders et al.

[11] Patent Number: 5,252,019

[45] Date of Patent: Oct. 12, 1993

[54] CONVENIENCE-FEATURE NON-CIRCULAR END CLOSURE WITH INTERRUPTED PANEL PROFILING

[75] Inventors: William T. Saunders, Weirton, W. Va.; Kevin Hanley, Cockeysville, Md.

[73] Assignee: Weirton Steel Corporation, Weirton, W. Va.

[21] Appl. No.: 928,418

[22] Filed: Aug. 12, 1992

Related U.S. Application Data

[62] Division of Ser. No. 823,295, Jan. 21, 1992, abandoned.

[51] Int. Cl.[5] ..... B21D 22/06; B21D 51/44

[52] U.S. Cl. ..... 413/67; 413/12; 413/15; 413/17

[58] Field of Search ..... 413/12–17, 413/67; 493/68

[56] References Cited

U.S. PATENT DOCUMENTS

| | | | |
|---|---|---|---|
| 1,838,302 | 12/1931 | Evans | 413/12 |
| 3,688,718 | 9/1972 | Shrecker | 413/12 |
| 3,741,142 | 6/1973 | Stuard | 413/17 |
| 3,945,334 | 3/1976 | Ostrem | 413/12 |
| 4,036,160 | 7/1977 | Kelley | 413/12 |

*Primary Examiner*—Bruce M. Kisliuk
*Assistant Examiner*—Jack Lavinder
*Attorney, Agent, or Firm*—Raymond N. Baker

[57] ABSTRACT

Forming a convenience-feature, sheet metal end closure structure (180, 216) for a container having a non-cylindrical side wall (250). Scoring and back-up tooling enable peripheral scoring (102, 130, 142) on either surface of such end closure to define a separable panel (160, 218) with its peripheral scoreline located contiguous to the end closure chuck wall (132, 144); which interfits within the open end of the container body. Separation of such endwall panel leaves substantially no obstruction to removal of solid-pack contents. The separable panel is provided with means to prevent tear-out of a segment of the endwall panel and retain an integral opener (148) with the panel. Preselected placement of such elongated integral opener as designated on various non-circular configuration endwall panels, along with novel shaping of tooling chuck (270), enables desired chuck wall support for chime seam assembly of the end closure a container body as well as desired placement of the opener working end contiguous to such chuck wall and peripheral scoreline.

3 Claims, 7 Drawing Sheets

FIG. 1 PRIOR ART
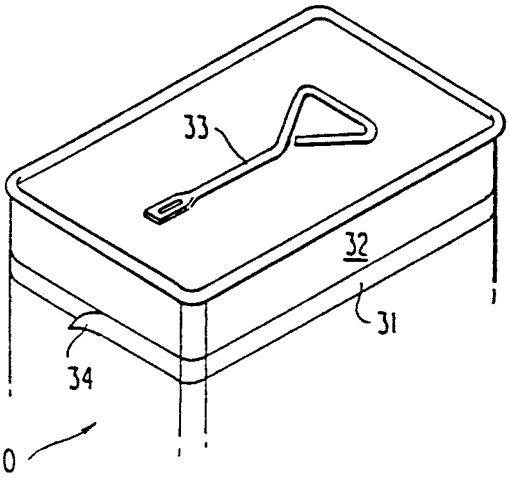
FIG. 2 PRIOR ART
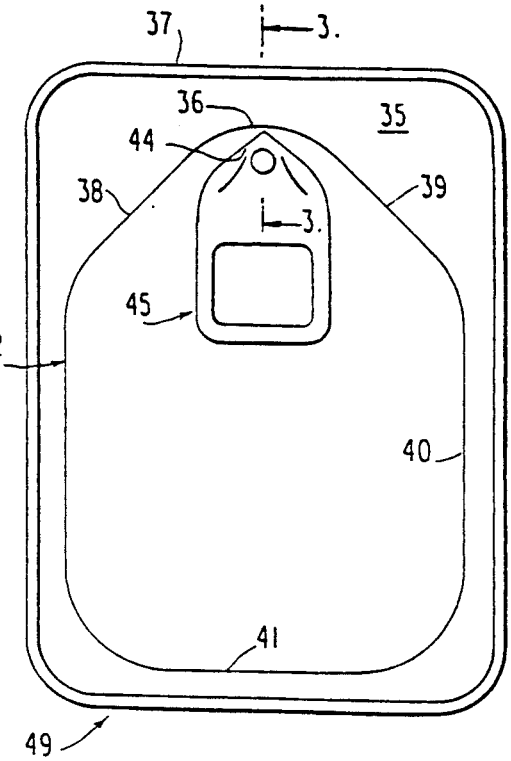
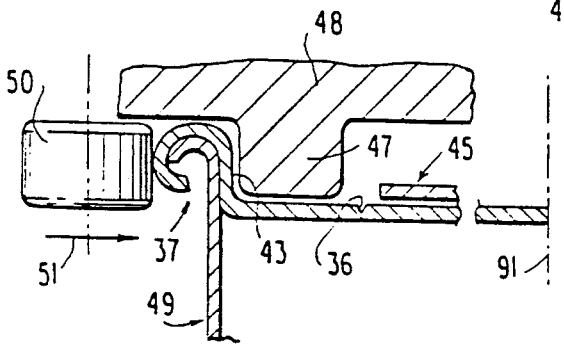
FIG. 3 PRIOR ART
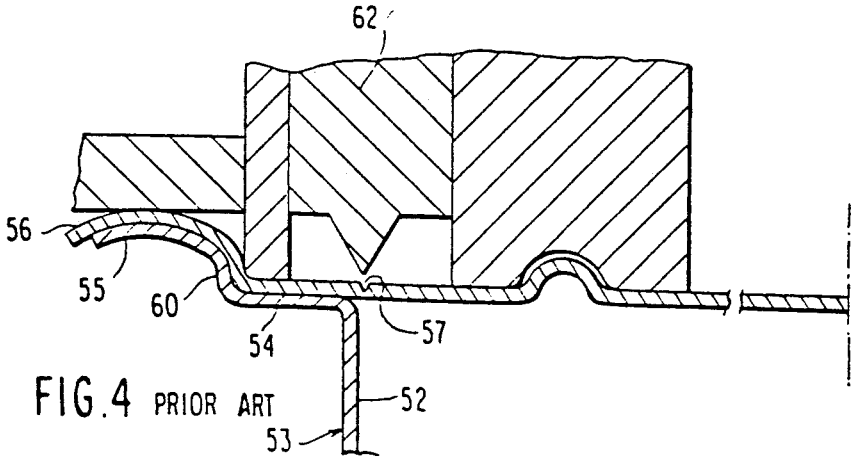
FIG. 4 PRIOR ART FIG. 5
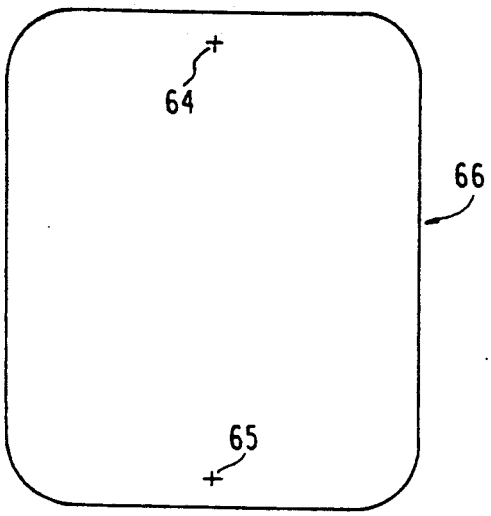
FIG. 6
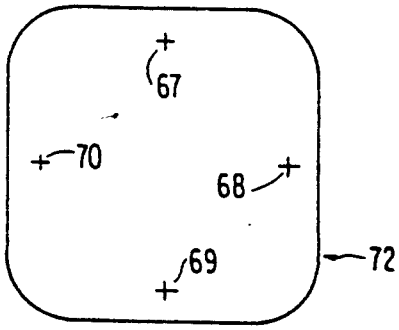
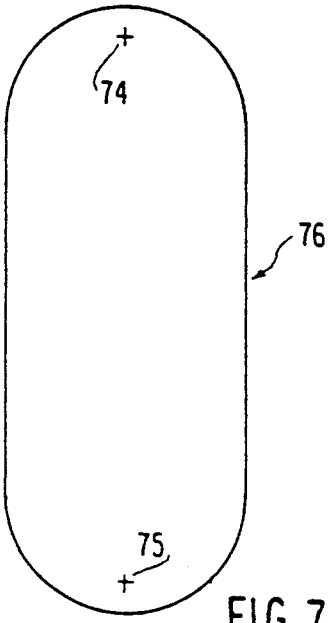
FIG. 7
FIG. 8
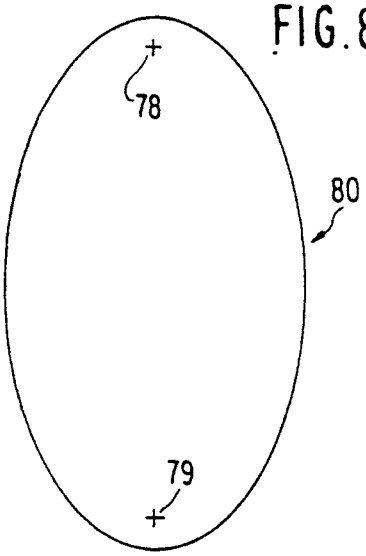
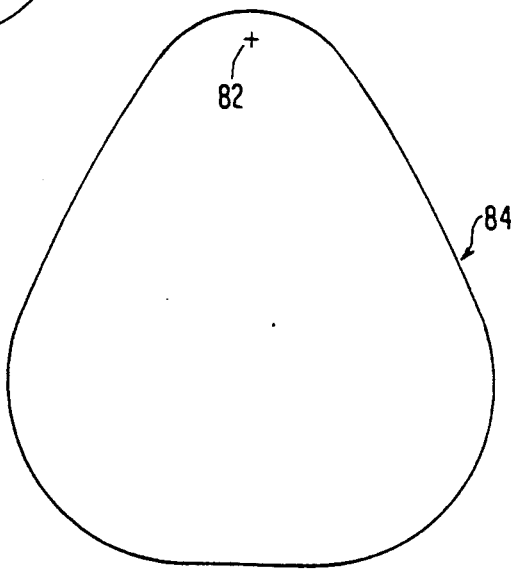
FIG. 9

FIG. 18
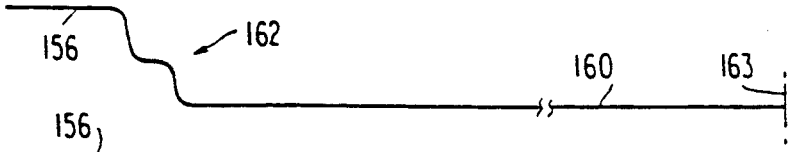
FIG. 19
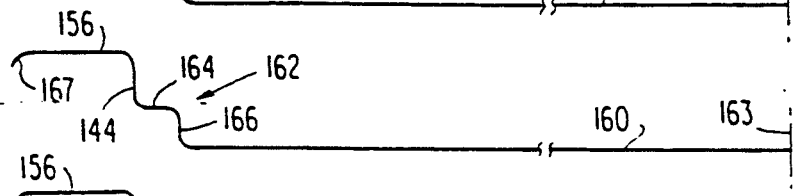
FIG. 20
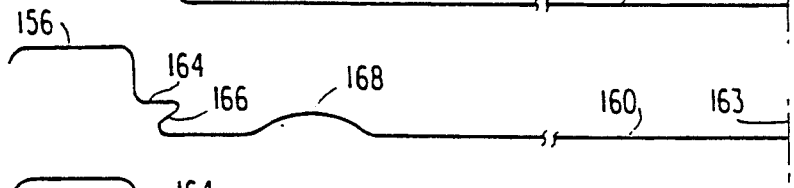
FIG. 21
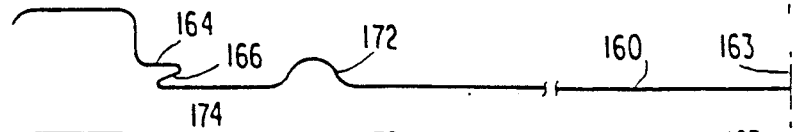
FIG. 22
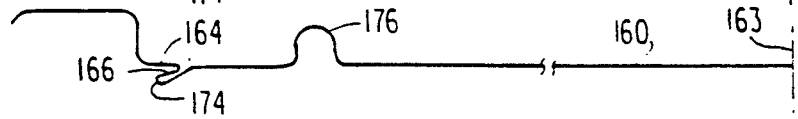
FIG. 23
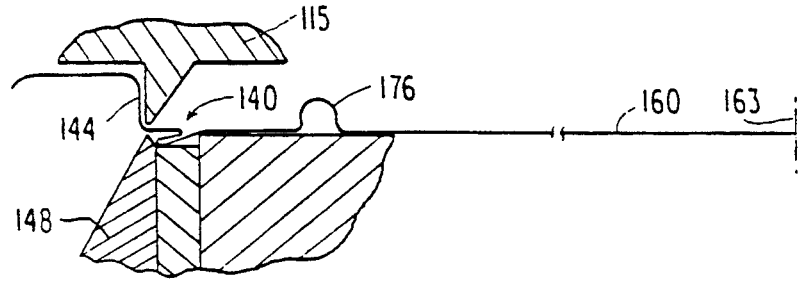
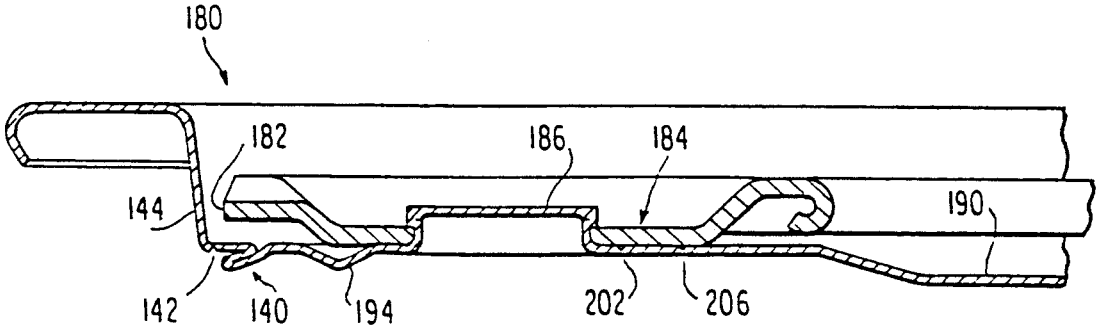
FIG. 24

FIG. 33
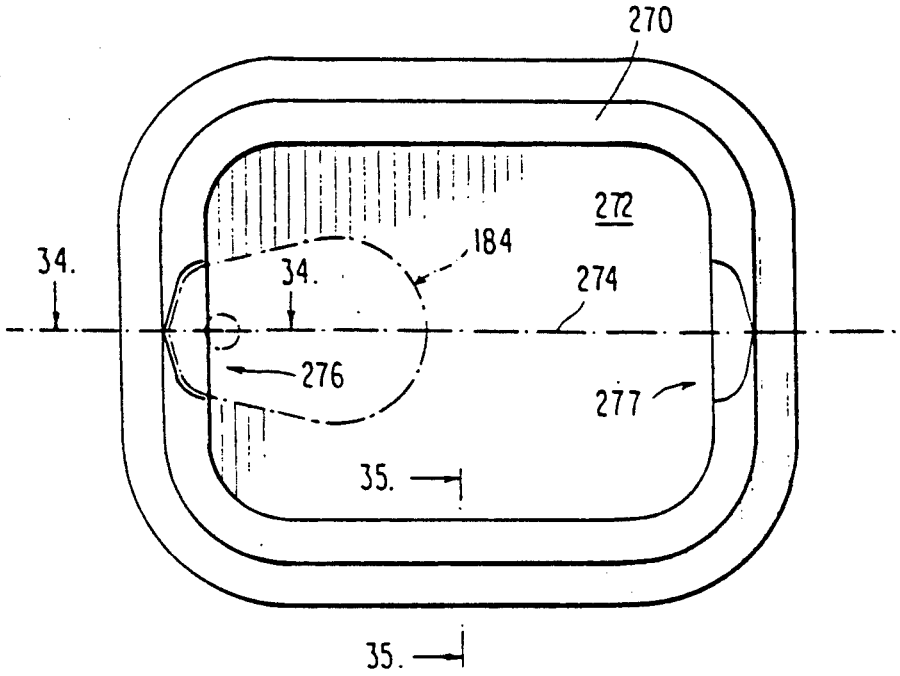
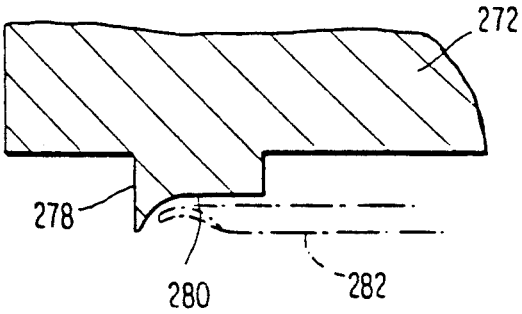
FIG. 34
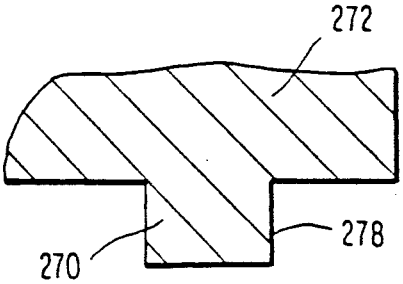
FIG. 35

CONVENIENCE-FEATURE NON-CIRCULAR END CLOSURE WITH INTERRUPTED PANEL PROFILING

This is a division of application Ser. No. 07/823,295, filed Jan. 21, 1992, now abandoned, the entire disclosure of which is incorporated herein by reference.

This invention relates to sheet metal end closures and methods and apparatus for fabricating sheet metal convenience-feature end closure structures which enable "solid-pack" removal of container contents. More particularly, the invention is concerned with convenience-feature end closures for container bodies having preselected non-cylindrical side wall configurations; also, with measures and means to enable endwall panel scoring on the external surface (public-side) or the interior surface (product-side) of such end closures; and, further, with preselected back scoreline configurations and new endwall profiling providing new non-circular end closures and opening procedures.

Solid-pack removal of corned beef product has been dependent on severing a scored strip extending around the container side wall to divide the container into two cup-shaped parts. Container contents are then available as a solid-pack, but, edges of the severed strip and side walls on both cup-shaped parts present potential hazards to safety during opening and/or removal of contents.

The present sheet metal non-circular convenience-feature end closure structures, and methods and means for fabricating such structures, enable unobstructed removal of solid-pack contents through a severed endwall panel opening.

The above and other contributions of the present invention, as well as prior practices, are described in more detail in relation to the accompanying drawings, in which:

FIG. 1 is a perspective partial view of a prior art solid-pack container which relies on side wall severance;

FIG. 2 is a top plan view of a can showing a prior art easy-open end closure with scoreline and integral opener;

FIG. 3 is a schematic, cross-sectional, partial view along the lines 3—3 of FIG. 2 for describing tooling orientation and tooling of the prior art for forming a chime seam between an end closure and the open end of a container body;

FIG. 4 is a schematic, cross-sectional, partial view for describing a prior easy-open end closure for solid-pack removal of container contents which relies on substantial increase in cross-sectional dimensions at the end of the container to be opened; and, for describing tooling used in fabricating such end closure prior to positioning for assembly as shown;

FIGS. 5 through 9 are, schematic plan views of non-circular end closure configurations (for container bodies having non-cylindrical side walls) for describing teachings of the invention relating to blank orientation and preselected locations for integral openers in accordance with the invention;

FIGS. 18 through 23 are schematic, cross-sectional partial views for describing sequential forming steps for an embodiment of the invention partially shown in FIG. 17;

FIG. 24 is an enlarged, cross-sectional partial view for describing added contributions of such end closure embodiment with a product-side multi-layer sheet metal fold for protecting the edge metal of a separable endwall panel;

FIG. 33 is a bottom plan view of chuck wall tooling for chime seam attachment of an end closure structure to a container body;

FIG. 34 is an enlarged partial cross-sectional view taken along the lines 34—34 of FIG. 33, and FIG. 35 is a partial cross-sectional view taken along the lines 35—35 of FIG. 33.

Figure 10:
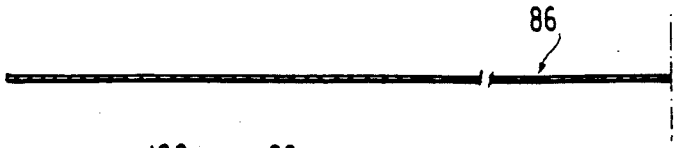
FIG. 10 is a "cut-edge" partial view (side view in elevation) of a flat-rolled sheet metal blank for forming non-circular end closure.

The prior art corned beef can 30 of FIG. 1 has a narrow-width scored strip 31 extending around the full perimeter of its rectangular cross section side wall 32. In a well known manner, a slotted key 33, which accompanies the assembled can, is fitted over tab 34 on strip 31 and, the key is rotated to open container 30.

Removal of the scored side wall strip 32 enables solid-pack removal of container contents; that is, it is possible to remove the contents as a single piece without relying on such contents being frangible. But, raw edge metal of the severed scoreline is exposed on both edges of the strip and on both side wall edges.

The prior art easy-open end closure for non-cylindrical can body shown in FIGS. 2 and 3 has been dependent on the contents being separable or frangible; for example, such end closure has typically been used for seafood parts, such as sardines, anchovies, or the like An endwall panel 35 is scored, as illustrated, with initial rupture location 36 being in spaced relationship (in the plane of panel 35) from chime seam 37. From such initial rupture location 36, the scoreline extends along angled legs 38, 39; and, continues in spaced relationship from chime seam 37 along the longer dimension (as represented at 40) of the can body and across the shorter dimension (as represented at 41) of the rectangular configuration end closure.

Closed scoreline 42 (which defines the removable panel) remains spaced (in the plane of the endwall) from the chime seam 37 throughout its length. Referring to a partial view of FIG. 2 shown in cross section in FIG. 3, chuck wall 43 extends from the upper level of chime seam 37 to recessed panel 35. In such prior art, it was essential that the working end 44 of an integral opener 45 be spaced (in the plane of the endwall panel) from such chuck wall 43 so as to provide access for chuck 47; the latter is part of tooling 48 for providing back-up support during closing of seam 37 about the upper chime of container 49 using seam roller 50. Such seam forming principles are known in the art; as well as the force required as seam roller 50 acts in the direction indicated by arrow 51 to inter-curl and roll the perimeter metal of the end closure and the flange metal of the can body to form the chime seam 37. Tooling 48 presents a wall support chuck 47 in order to provide backing in a direction opposite to that of arrow 51 during such shaping of perimeter metal of the end closure and the open-end flange metal of the container body.

Another prior art approach to an easy-open end closure is shown in the schematic, cross-sectional, partial view of FIG. 4. The container body is extended outwardly beyond the cross-sectional profile of side wall 52 at the open end of can body 53. Such approach involves use of an outwardly projecting ledge 54 and in addition, utilizes flange metal 55 at the open end of can body 53.

Flange metal 55 is used to form a seam with perimeter metal 56 of an end closure. Endwall scoring of such an end closure structure is located at 57 (FIG. 4) so that the scoreline is disposed slightly within the profile of the inner surface of side wall 52; that is, sufficient clearance has to be provided to enable an opener and endwall panel metal to turn inwardly of the container without obstruction by the curvilinear transition zone between sidewall 52 and ledge 54.

Can body ledge 54 leads to wall 60 (FIG. 4) and the latter leads to flange metal 55. Scoreline 57 which defines the endwall panel to be separated is formed in an end closure fabrication stage (not when positioned on a container body as shown schematically for other description purposes in FIG. 4) with a conventional scoring tool, such as 62, which in the cross-sectional view shown, is symmetrical to the axis of movement passing vertically through the scoring knife edge and scoreline 57.

Shortcomings of the type of prior art end closure shown in FIG. 4 comprise abuse problems with such ledge and other enlarged cross-sectional portions at the open end of a container during fabrication and during handling for filling such container body or during sealing with an end closure. Also, lack of material economics is a disadvantage since added material is required for both the container body and end closure.

However, unique tooling concepts of the present invention enable endwall panel scoring to take place (on either the public or product side of an end closure) contiguous to the chuck wall with no such added material costs or handling difficulties. Such endwall panel scoring enables solid-pack removal since the newly opened end of a non-cylindrical container body is unobstructed because the endwall panel is severed at substantially the same location as when a "roll-knife" can opener is used on a conventional end on a cylindrical can body.

Non-cylindrical side wall container bodies, along with end closures which are non-circular in plan view, are partially described in the Dewey and Almy Can Dimension Dictionary (Dewey and Almy Chemical Division, W. R.. Grace Co., Cambridge, Mass. 02140); page 3 of that text points out that "All non-circular ends—(with the exception of square ends)—have two dimensions, a longer dimension and a shorter dimension."

The present invention is particularly concerned with non-circular end closure structures for container bodies having non-cylindrical side walls selected from the group consisting of "rectangular" (FIG. 5), "square" (FIG. 6), "oblong" (FIG. 7), "elliptical" (FIG. 8), and "pear-shaped" (FIG. 9).

A further concept of present teachings which facilitates blank handling, blank fabrication, and opening of convenience-feature non-cylindrical end closures involves preselection of rivet button locations for riveting an opener to a separable endwall panel. As taught herein, the rivet button (as well as resulting rivet) is located along the centerline of a major dimension (in plan view) of the end closure configuration; and, for other than the "square" configuration, such major dimension comprises the centerline of the longer dimension for such end closure.

As taught herein, an integral opener rivet can be located at 64 or 65 on the rectangular end closure 66 of FIG. 5; at positions 67, 68, 69 or 70 on the square configuration end closure 72 of FIG. 6; at positions 74 or 75 on the "elliptical" end closure 76 of FIG. 7; and, at 78 or 79 on the "elliptical" end closure 80 of FIG. 8.

However, a single potential position is designated at 82 for the "pear-shaped" end closure 84 of FIG. 9. Such "pear-shaped" configuration, or an end closure having configurational characteristics similar to that of FIG. 9 (that is, with smaller and larger longitudinal ends in plan view) simplifies registry problems during entry into and feed through forming press stations such that a single rivet location is designated.

In the configurations of FIGS. 5, 7, 8, and 9, the preselected rivet position is located along (contiguous to the longitudinal end of) the single centerline dimension which divides the blank and end closure into equal halves along the longer dimension. In the "square" configuration end closure 72 of FIG. 6, the potential locations for an integral opener rivet are preselected near opposite ends of either equal dimension axis, each of which divides the blank and end closure in half. With all such configurations (FIGS. 5 through 9) of the invention the dimensional axis relied on divides the end closure into equal mirror-image halves; that is, no diagonal or minor axes are selected.

Preselection of possible rivet locations (FIGS. 5 through 9) for integral openers, as taught herein, facilitates handling during fabrication of cut blanks into end closure shells; and, also provides for desired placement of a rivet location and an integral opener with the longitudinal axis of such opener coincident (that is, in the same cross-sectional plane which includes the height axis of the container) with that central dimensional axis selected for the end closure.

Further, such preselection is a part of the ability to locate the peripheral scoring for an endwall panel contiguous to the chuck wall of end closure structure, as taught herein. A coordinated concept in this ability involves devising new and differing configuration tooling chucks to provide chuck wall support; such support would not otherwise have been available during formation of a chime seam based on the teachings of the prior art. The tooling combinations of the invention thus make solid-pack removal of contents through a container endwall attainable and practicable for commercial production purposes.

In the shell-forming stage, during fabrication of flat metal blank (FIG. 10) into an end closure, chime seam metal 87 (FIG. 11) is formed adjacent the "cut-edge"-perimeter of such blank; and, an endwall panel 88 is countersunk forming chuck wall 90. The chuck wall is oriented in an axial direction toward the interior for an assembled container. Such chuck wall of an end closure fits closely within the can body side wall at its open end; the profile (plan view) of each has matching configurational and dimensional characteristics ("plan view" refers to a view in a plane which is perpendicularly transverse to the centrally located height axis for such a container).

The spacing of the peripheral scoreline from the chuck wall previously required was described in relation to FIGS. 2 through 4 above. However, as taught herein, an elongated integral opener is positioned initially, and is secured in place, with its working end contiguous to the end closure chuck wall. Enabling preselected placement of such working end and fixing of such elongated integral opener in place while still providing for proper back-up support for the chuck wall during chime seam formation is the result of significant contributions of combinations of coacting concepts of the invention.

As taught herein, the longitudinal axis of the elongated opener is located coincident (in the same vertically-oriented plane which includes the central height axis for an assembled container) with the selected major dimensional axis of the end closure for location of the rivet. In each configuration of FIGS. 5 through 9, the dimensional axis selected bisects the rivet for securing an elongated opener to the closure. Also, such major dimensional axis selected (for reasons relating to facilitating opening as described later) bisects the adjacent starting section of the peripheral scoreline as well as that linear or curved "side" (in plan view) of the end closure.

Two possible rivet locations are available in all but the "square" configuration of FIG. 6 (which provides four possible rivet locations) but, a single possible location 82 is designated for a rivet in the "pear-shaped" configuration 94 of FIG. 9. The possible preselections taught herein are important (a) for purposes of work product orientation during fabrication of an end closure, (b) during placement or implementation of convenience features and (c) during assembly of a container. Combined and coacting with other concepts of the invention, such preselections make convenience-feature endwall opening, for solid-pack removal of contents, practical.

Figure 11:
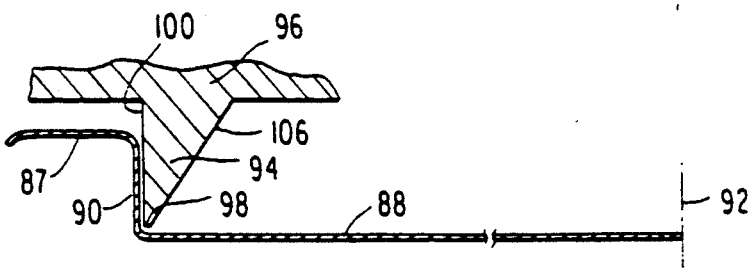
FIG. 11 is a partial view in cross section of a shell formed from the blank of FIG. 10 along with scoring tooling for "public" side scoring in accordance with the invention.
Figure 12:
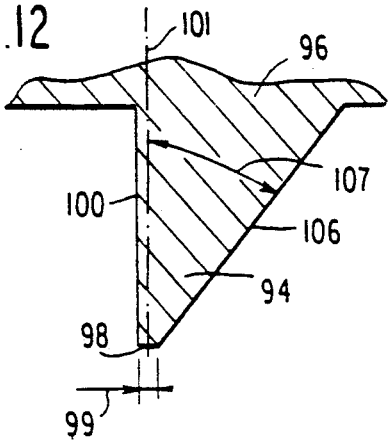
FIG. 12 is an enlarged cross sectional view of a scoring knife of the invention.
Figure 13:
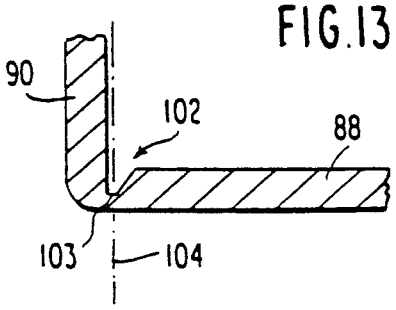
FIG. 13 is an enlarged view of a sheet metal portion of FIG. 11 for describing positioning of the peripheral scoreline.

FIGS. 11 through 13 are concerned with peripheral scoreline formation on the public side of an end closure and FIGS. 14 through 17 are concerned with forming a peripheral scoreline on the product side of an end closure.

The juxtaposition between scoring tooling and end closure structures for such external surface scoring is shown in a cross-sectional plane which includes the central height axis 92 of FIG. 11. The novel configuration of scoring knife 94 of scoring tool 96 for such scoring is shown in greater detail in FIG. 12. This configuration enables the scoring knife 96 to operate contiguous to chuck wall 90. Scoring knife 96 preferably (as shown) has a narrow truncated working edge 98. The dimension, measured as indicated at 99 in such cross-sectional plane of such knife edge 98, is selected between about 0.001" to 0.002" for typical consumer-use size containers such as the 303×208 end closure for a corned beef container to 0.007" (303 refers to 3 3/16" for the longer dimension; 208 refers to 2 8/16" for the shorter dimension).

Scoring knife side wall 100, (as shown in the cross-sectional view of FIG. 11) abuts chuck wall 90; side wall 100 has substantially the same configuration, in plan view, as the chuck wall. Scoring knife side wall 100 is substantially parallel (as seen in the cross-sectional view shown) to the contiguous surface of such chuck wall permitting relative movement between the scoring tooling and end closure wall along the direction of axis 101 (of the scoring knife 94 which bisects the scoring edge 98). Typically such axis 101 could be located between 0.001" and about 0.010" from the chuck wall depending on end closure product and tooling requirements. Chuck wall 90 is typically vertically oriented; or, has a minor included angle of less than about 5° with such axis (that is with its upper end being toward the outer periphery during initial shell forming stages).

The public side peripheral scoreline at 102 in FIG. 13 has an axis 104 which bisects the maximum depth portion 103 of the scoreline 102. Rupture during opening can be expected to occur along axis 104; that is, within a range from less than 0.001" to about 0.010" of such chuck wall (as measured in plan view of such end closure) by utilizing a scoring knife edge 98 having a dimension between about 0.001" and 0.002".

In the cross section shown, the configuration of the scoring knife 94, as it protrudes from the pad portion of scoring tool 96, presents essentially a truncated version of a right-angled triangle with hypotenuse side 106 at an angle of about 30°, (for example as indicated at 107 in FIG. 12) with the axis of movement of the scoring knife.

Such scoring knife cross-sectional configuration is carried out throughout its full plan view configuration so as to enable the peripheral scoreline for the end closure to be contiguous to the chuck wall without interfering with adjacent convenience-feature structures during such peripheral scoring operation.

Figure 14:
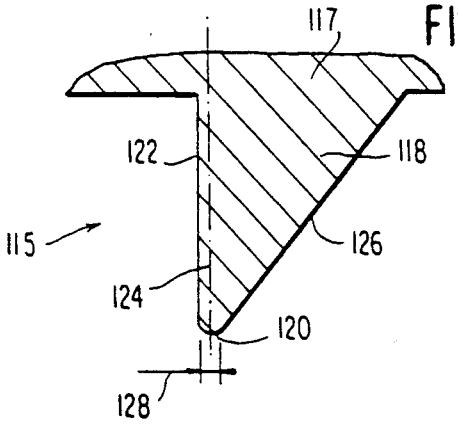
FIG. 14 is a schematic, cross-sectional, partial view of backing tooling of the invention used for product-side (interior surface) peripheral scoring of an end closure.

FIGS. 14 through 17 are concerned with peripheral scoring on the product side of an end closure (interior surface when assembled into a container). The backing tooling configuration of FIG. 14 is provided for the embodiments of both FIGS. 16 and 17. Backing tooling 115 comprises pad 117 and a back-up tool 118 which protrudes (as shown in cross section in FIGS. 14, 16 and 17) from pad 117. Back-up tool 118 presents backing surface 120 at its distal end.

The cross-sectional view of backing tooling 115 has a right-angled triangle configuration which is truncated (with rounded edges) at such backing surface 120 distal end. Side wall 122 is in substantially right-angled relationship to the surface of pad 117; and, substantially parallel to the axis of movement 124 which bisects end 120; or, is within less than about 5° of such a parallel relationship. Side wall 126 defines an included angle of about 30° with such axis 124.

The backing edge 120 has a cross-sectional width of about 0.002", as measured at 128, to provide required backing while allowing for metal movement during scoring relying on such narrow width backing surface as seen at 128 in cross-sectional view. In plan view, the backing edge 120 conforms to that of the scoring edge (shown in later FIGS.) to bring about the desired uniform depth scoreline formation about the entire periphery of the endwall panel to be separated.

Figure 15:
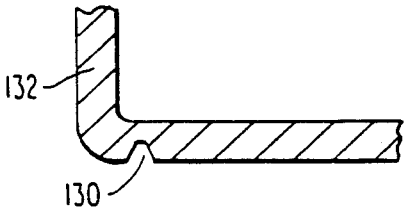
FIG. 15 is a enlarged cross-sectional partial view for describing the positional relationship of such product-side peripheral scoreline to the end closure chuck wall.

FIG. 15 shows (in cross section) the internal scoreline 130 which is contiguous to the profile of chuck wall 132 so as to provide severing for a non-obstructed opening as described earlier.

Figure 16:
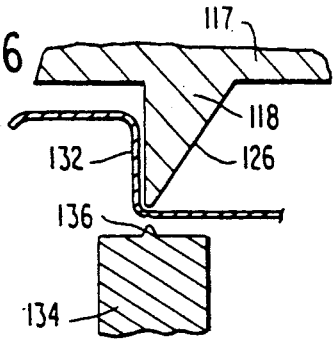
FIG. 16 is a schematic, cross-sectional partial view for describing the interrelationship of the backing and scoring tooling for such product-side scoring of an end closure embodiment which is free of multi-layer sheet metal fold shielding for the separable endwall panel.

As shown in FIG. 16, internal scoring tooling 134 is substantially unobstructed adjacent to the scoring location so that scoring knife 136 need only protrude from the main body portion of scoring tooling 134 (as shown in cross section) a relatively short distance so that adequate scoring knife strength is provided without special scoring tooling shaping.

Figure 17:
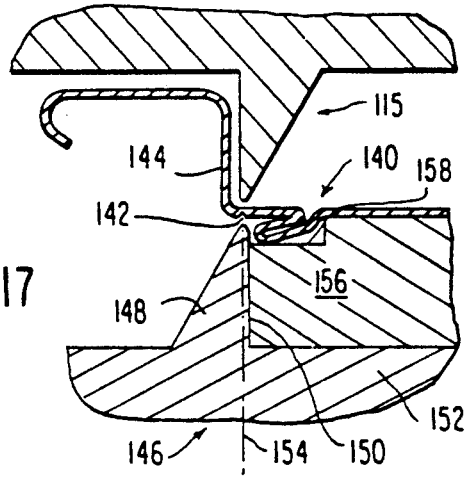
FIG. 17 is a schematic, cross-sectional, partial view for describing the interrelationship of backing and scoring tooling for product-side scoring of an embodiment of the invention with a multi-layer fold of sheet metal on such interior surface.

In FIG. 17, scoring is carried out on the internal surface of an end closure contiguous to multi-layer sheet metal fold 140 which is at least partially formed at the time of scoring. The backing tooling 115 (shown in more detail in FIG. 14) is used on the exterior surface to provide back-up for the scoring taking place on the product-side in the embodiments of both FIGS. 16 and 17.

In order to accomplish the desired positioning of the scoreline 142 contiguous (in plan view) to the profile of chuck wall 144, special configuration scoring tooling is used in the embodiment of FIG. 17. Scoring knife 148 has a side wall 150 which abuts a pad 156 having a recess 158 which allows for clearance of multi-layer fold 140. Such side wall 150 is substantially perpendicular to the pad portion 152 of tooling 146; or, is within less than about 5° of an axis of movement for the scoring tool indicated at 154.

FIGS. 18 through 23 show the sequence of steps for the embodiment (partially shown in FIG. 17) in which a multi-layer sheet metal fold for protecting severed edge metal of a separable endwall panel is located on the product side of such panel. A flat-rolled metal blank (such as 86 of FIG. 10) is formed into a shell by shaping perimeter metal 156 as shown in FIG. 18 and countersinking endwall panel 160. A stepped configuration 162 (as viewed in cross section in a plane which includes the center height axis 163) provides the desired countersinking and also provides the sheet metal portions for forming such multi-layer fold.

FIG. 19 shows the desired right-angled relationship between chuck wall 144 and a "tread" portion 164 of the stepped configuration 162; "rise" portion 166 of such stepped configuration is oriented to be substantially parallel to the direction of axis 163 (that is substantially perpendicular to the planar portion of endwall panel 160). The distal edge of perimeter metal 156 is curled as shown at 167 during such orientation of chuck wall 144 and tread portion 164.

In FIG. 20, a broad-based dome 168 for a rivet button is formed in the endwall panel 162; and, a sheet metal folding action is initiated with the metal in rise portion 166 of the stepped configuration 162 taking the angled relationship shown. Such folding action is started by moving recessed endwall panel 160 in the vertical direction, as illustrated, toward perimeter metal 156.

In FIG. 21, a second, narrower cross-section, increased height, rivet button dome 172 is formed as the metal folding action continues. Rise portion 166 which was vertically oriented is being moved into closer ("folded") relationship with tread portion 164; and, a perimeter portion 174 of endwall panel 160 is being positioned for the desired triple layer sheet metal fold relationship.

In FIG. 22, the final rivet button configuration 176 is formed as the multiple layers of sheet metal, including panel perimeter portion 174 of the endwall panel 160, are nearing completion. As shown in FIG. 23, tooling 115 is positioned as scoring knife 148 completes impression of the peripheral score 142. The multi-layer fold 140 is nearing completion; in its final orientation (FIG. 24) a rounded edge portion will be in a position to shield severed edge metal of panel 160 by blocking direct access to such raw edge.

Figure 25:
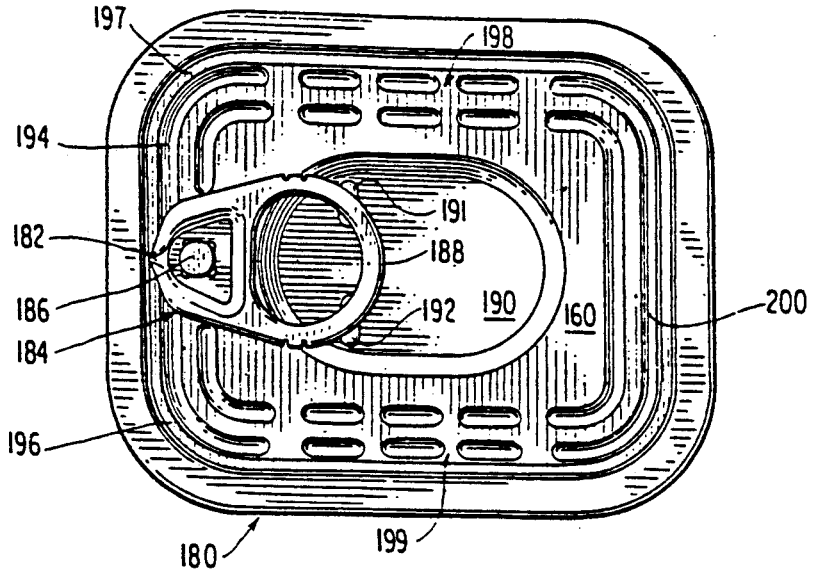
FIG. 25 is a top plan view of the end closure embodiment of FIG. 24 showing profiling means in more detail.

FIG. 24 presents an enlarged cross-sectional, partial view of end closure 180 with integral opener 184 in place. A top plan view of end closure 180 is shown in FIG. 25 and a bottom plan view of end closure 180 is shown in FIG. 26.

The cross-sectional view of FIG. 24 is taken in a plane which includes both the major dimensional axis of the end closure and the longitudinal axis of an integral opener. Chisel point working end 182 of opener 184 is held in contiguous relationship with scoreline 142 and chuck wall 144 by rivet 186. Handle end 188 extends over recessed finger-access panel 190 in which protrusions 191, 192 help to hold opener 184 in generally parallel relationship to the planar portion endwall panel 160, prior to opening.

Profiling means are recessed in such endwall panel as shown in the cross-sectional view of profiling bead 194 of FIG. 24. As seen in FIGS. 25, 26, profiling bead 194 extends across the shorter dimension side and continues around corner portions 196, 197 (which corresponds to the portion of the peripheral scoreline which is ruptured initially by lever action at opener 184). Such profiling is interrupted along the longer dimension sides (as indicated at 198, 199) and, then, continues at 200 across the remaining shorter dimensional side of the end closure.

Figure 26:
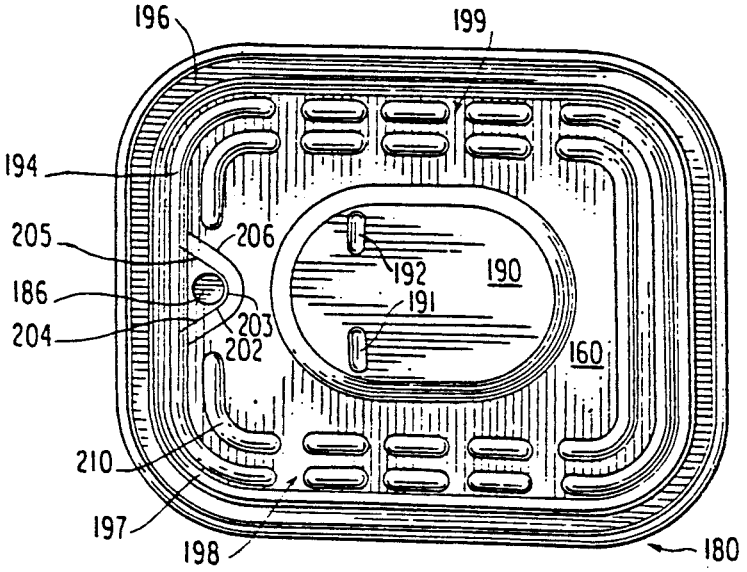
FIG. 26 is a bottom plan view of the end closure embodiment of FIG. 25 showing arch-shaped back scoreline means.

The back (mustache-shaped) scoreline means of FIG. 26 includes an arch-shaped scoreline 202 (which is to be ruptured) presenting a center portion 203, with a single leg (204, 205) extending from such center portion on each side of rivet 186. Such legs extend into profiling rib 194 but terminate at the multi-layer fold 140 before intersection with scoreline 142. An auxiliary scored configuration 206, of shallow depth compared to back scoreline 202, stiffens the metal around back scoreline 202 providing some abuse resistance for scoreline 202 and facilitates a snap-action rupture of scoreline 202 by Class II lever action.

Another panel profiling rib means 210 extends from locations adjacent to each side of scored configuration 206. Profiling means 210 is located inboard of, but generally follows the configuration of profiling rib means 194; and, is interrupted similarly along the longer sides of end closure 180. Such interruptions in both profiling ribs facilitate opening in a manner in which endwall panel 160 can roll-back on itself during opening subsequent to initial rupturing of the peripheral scoreline as shown and described later.

Figure 27:
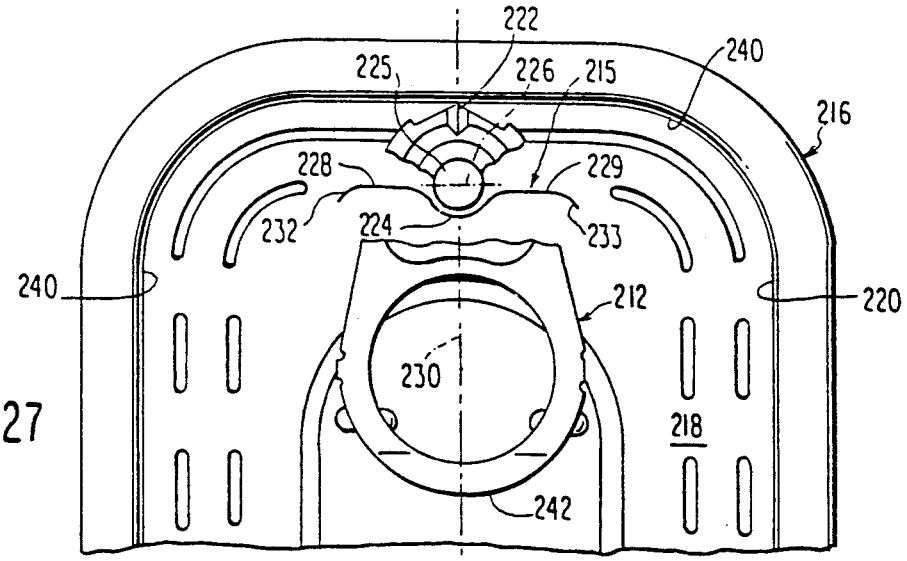
FIG. 27 is a schematic top plan partial view of another end closure embodiment of the invention for describing functions of the back scoreline means illustrated.

In the top plan, partial view of FIG. 27, portions of opener 212 have been cut away to better view the orientation of "reverse handle-bar mustache" configuration of back scoreline 215 on endwall panel 218. The FIG. 27 end closure corresponds to that of the embodiment of FIG. 16; that is, it is free of a multi-layer fold of sheet metal at the perimeter of the endwall panel. The working end 222 of opener 212 (FIG. 27) is contiguous to the peripheral scoreline and chuck wall of the end closure; and the panel profiling has the same configuration as described in relation to FIGS. 25 and 26.

The back (mustache-shaped) scoreline 215 has a central portion 224, circumscribing a portion of rivet 225. Such circumscribing by central portion 224 must not pass the central point axis 226 of rivet 225; therefore legs 228, 229 are each directed on opposite sides of the rivet along directions which are perpendicularly transverse to the central longitudinal axis 230 of the opener and end closure; then, such legs each turn backwardly to form angled ends 232, 233. Such leg portions are oriented in such opposite directions at a location at least about 1/32" from axis 226 through the rivet center.

Rupturing central portion 224 vents the container; and, leads to laterally directed legs 228, 229—which act as the fulcrum for lever action severance of the peripheral scoreline 240 at the chuck wall (indicated as 220 in FIG. 27). The momentum of the arcuate movement as handle end 242 of opener 212 is lifted to rupture central portion 224 is transferred to the chisel point working end 222 of opener 212; such abrupt action facilitates initial puncture of the peripheral scoreline. Back scoreline legs 228, 229 stop or limit undesirable movement of the working end 222 in the plane of endwall panel 218. Angled end portions 232, 233 of the back scoreline 214 prevent tear-out of a portion of the endwall panel and retain opener 212 with endwall panel 218.

Figure 28:
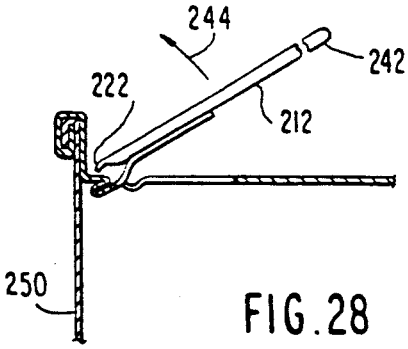
FIGS. 28 through 32 are schematic cross-sectional partial views for describing opening procedures utilizing the interrupted profiling means of the invention.
Figure 29:
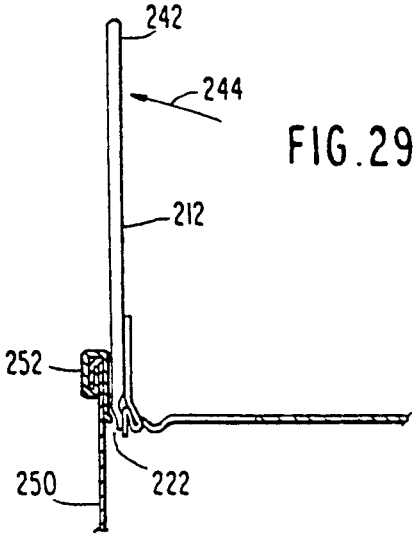
Figure 30:
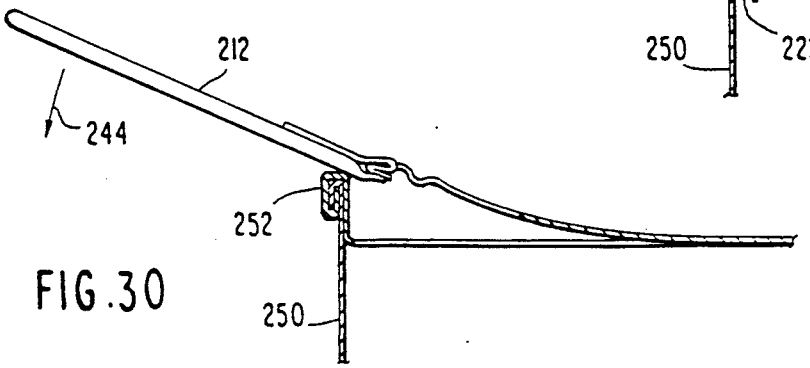

The opening procedure described in relation to following FIGS. 28 through 32 applies to the embodiment without the multi-layer fold (FIGS. 16, 27) and the multi-layer fold embodiment of FIGS. 17, 26, 27 (however, only the multi-layer fold is illustrated). After lifting the handle end of the longitudinally-rigid opener to move in an arcuate direction as indicated by arrow 244 to rupture the back scoreline central portion, as shown in FIG. 28, such angular movement continues by Class II lever action as shown in FIG. 29 to rupture the peripheral scoreline with working end 222. Such arcuate movement continues until the opener 212 is vertically oriented parallel to side wall 250; and, beyond as shown in FIG. 30 making contact with chime seam 252 with "over-the-side" movement as indicated by arrow 244.

Figure 31:
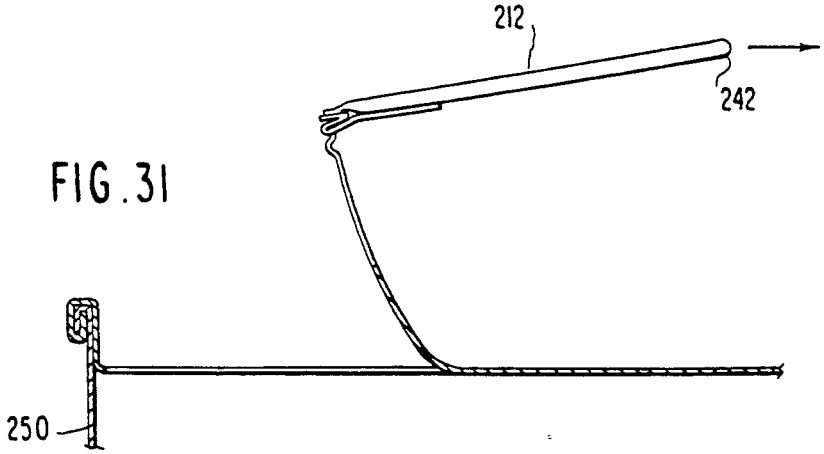
Figure 32:
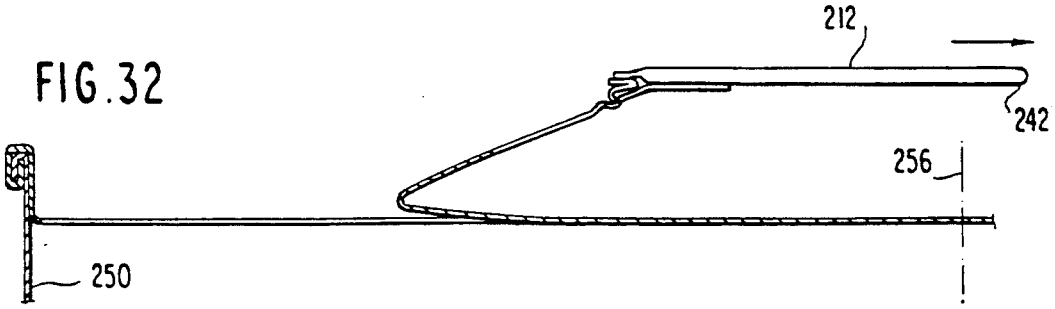

After rupture of the peripheral scoreline along the shorter dimension of the panel and around the corner portions of such rectangular configuration, the handle end 242 of opener 212 can be pulled backwardly toward the center height axis 256 (FIG. 32) as shown in FIG. 31 and continued in FIG. 32. Such "roll-back" movement is preferable for the embodiment of either FIGS. 16, 27 but available with FIGS. 17, 25, 26 because of the interrupted profiling shown in FIGS. 25 through 27.

Peripheral scoreline rupture along the shorter dimension side and corners is by Class I lever action of the opener. Subsequent "roll-back" action causes the scored metal along the longer dimension sides of the end closure to be severed by a tearing action augmented by mechanical advantage due to the endwall panel itself—which makes separation profoundly easier than trying to separate scored metal by pulling against the tensile strength of such metal. The scored metal at the remaining shorter dimension side readily breaks as the entire panel is pulled over that side of the container.

The initial rupture of the peripheral scoreline for configurations 66 and 72 of FIGS. 5 and 6 requires more pronounced "over-the-side" lever-action of the longitudinally-rigid integral opener utilizing the chime seam contact as a fulcrum in order to rupture around corner portions of such side and, at least in part, along the remaining dimensional sides as described in associated patent application which is incorporated herein by reference, entitled "Convenience-Feature End Closure for Container Body with Non-Cylindrical Sidewall", filed on the same date as the present application in the name of William T. Saunders, and assigned to the same assignee The smaller rounded side of an elliptical configuration such as 30 of FIG. 8, can provide for earlier roll-back action opening utilizing the interrupted profiling of FIGS. 25 through 27.

FIGS. 33 through 35 set forth various views for describing (wall support) chuck 270 of tooling 272. Chuck 270 protrudes as shown in FIG. 35 from the base of tooling 272 with a plan view configuration as shown in FIG. 33; such plan view configuration is selected to match dimensional and configurational characteristics of the chuck wall of an end closure configuration selected from FIGS. 5 through 9 in order to provide support for the chuck wall.

Such chuck wall support is essential in order to form the chime seam because of the substantial lateral force required to curl and roll end closure perimeter metal and a container body flange to form a chime seam. A significant contribution of the invention relates to providing such chuck wall support, in a direction opposing such laterally directed force of the seaming roll, around the full chuck wall surface while providing preselected access, for desired location of the working end of an integral opener as positioned at one of the preselected locations described in relation to FIGS. 5 through 9. Such chisel-point working end of the opener is received in a cut-away opening in chuck 270 which enables positioning the working end chisel-point of the opener contiguous to the peripheral scoreline to be ruptured and to the chuck wall while still maintaining desired chuck wall support for forming the chime seam.

Teachings on such preselections of FIGS. 5 through 9 enable preparation of tooling to carry out such objectives for each of such configurations. Utilizing the accompanying teachings and the description of the rectangular embodiment of FIGS. 33 through 35, other wall support tooling configurations for the other embodiments (FIGS. 6 through 9) can be devised and prepared by those skilled in the art.

The rectangular chuck configuration for a rectangular end closure embodiment provides for a selection of an integral opener rivet location at either end of the longer dimension main axis 274 (FIG. 33). The access portions provided for such possible positioning of the working end of an integral opener are located in opposed relationship as shown at 276 and 277 in FIG. 33.

Access portion 276 has a cut-away configuration indicated in part by surface 280 shown in cross section in FIG. 34. Chuck wall support surface 278 has a decreased thickness, in approaching the distal end of the protruding chuck as indicated in FIG. 34; and, a decreased thickness along a short length portion of the chuck perimeter (FIG. 33) which is also at the protruding distal end of chuck 270. Such cut-away access is supported by contiguous portions of the chuck 270 which continue above such distal end and along such perimeter. Angled cut-away portion 280 allows the opener (as indicated in interrupted lines at 282) to be positioned where desired contiguous to the peripheral scoreline to be ruptured when the opener is initially secured in place by the rivet.

Typical specifications for a 303×208 end closure are as follows:

| Sheet Metal: | Nominal Thickness | |
|---|---|---|
| Steel | about | 70 to 90 lbs./bb |
| Aluminum | about | .008 to .014" |
| Scoreline: | | |
| Peripheral | | |
| Residual Steel Thickness | about | .002-.003" |
| Residual Aluminum Thickness | about | .0045-.0055" |
| Back | | |
| Residual Steel Thickness | about | .002-.003" |
| Residual Aluminum Thickness | about | .0045-.0055" |
| Auxiliary Scored Configuration (206) | | |
| Residual Steel Thickness | about | .0045" |
| Residual Aluminum Thickness | about | .005-.006" |
| Radius of Central Portion (203, 224) | | .125" |
| Included Angle (Between Legs 204, 205) | | 60° |
| Length of Legs 204, 205 | about | .185" |
| Width between Distal Ends of Legs 204, 205 | about | .250" |
| Spacing Between Rivet Center Axis 226 and Parallel Leg Portions 228, 229 (FIG. 27) | about | .03 to .05" |
| Rectangular Configuration End Closure | | |
| Longer Dimension | | Shorter Dimension |
| 3 3/16" | × | 2 8/16" |
| Peripheral Scoreline | | |
| 3.035" | × | 2.352" |
| Endwall Panel "160" | | |
| 3.035" | × | 2.352" |
| with radius at each corner | about | .600"-.605" |
| Countersunk Panel (160) | about | .085" |
| Finger Access Recess (190) | about | .03" |
| Opener Supports (191, 192) | about | .02" |
| Profiling Rib Recess | about | .02" |
| Rivet Height | about | .04" |

Typically, the sheet metal is coated with an organic coating to prevent metal dissolution. Product side scoring would be protected on a steel end closure when tin plated steel is used for the container. Otherwise; repair of the coating at internal scoring locations, or public-side scoring, should be used.

Preferably, the elongated longitudinally rigid opener is made from flat-rolled steel of about 0.012" nominal thickness gage to about 0.017" nominal thickness gage; if made from aluminum the thickness gage would extend from about 0.012" to about 0.022". The overall length of such opener for the above described 303×208 end closure is about 1.5". The opener sheet metal is longitudinally reinforced about the rivet as well as by curling of the edge metal along its length and around a ring-shaped opening when such an opening is used. Edge metal curling techniques are known in the art. The sheet metal of the opener about the rivet is not lanced—rather the back scoreline, as described above, ruptures while the opener retains its longitudinally-rigid characteristic for the various lever-action opening functions described.

Specific details of non-circular configuration end closure materials and dimensions have been set forth to provide a better understanding of the invention; however, in light of the above teachings, such specific values are subject to modifications while utilizing the new concepts taught herein; therefore, in interpreting the scope of the present invention reference shall be had to the appended claims.

We claim:

1. Scoring apparatus for forming a peripheral scoreline in a non-circular sheet metal endwall panel of a convenience-feature end closure for a non-circular can body providing for unobstructed removal of solid-pack contents of the can body, which panel is in recessed relationship to chime seam metal for the end closure, the endwall panel having an external-surface public side and an internal-surface product side with the peripheral scoreline being formed in the product side of the endwall panel, and in which the chime seam metal is located peripherally of the endwall panel with a chuck wall located about the periphery of the endwall panel joining the chime seam metal and recessed endwall panel, comprising:

scoring tooling for locating the scoreline for the endwall panel on the product side of the end closure for severance about the periphery of the endwall panel at a location contiguous to the chuck wall, backing tooling for confronting the public side of the endwall panel to provide panel sheet metal backing support at a location contiguous to the chuck wall along the length of the peripheral scoreline as scoring is carried out on the product side of the end closure, the backing tooling including:

a pad portion a back-up tool portion protruding from the pad portion toward the public-side surface of the end closure, with the back-up tool portion protruding from the pad portion a dimension exceeding the combined height dimension of the chuck wall and chime seam metal above the recessed endwall panel, the back-up tool portion having configurational and dimensional characteristics about the endwall panel periphery to enable the back-up tool portion to fit within, and in contiguous relationship to, the chuck wall, the back-up tool portion having a peripherally-outer side wall surface parallel to and abutting the chuck wall, an inner periphery side wall surface disposed, when the back-up tool portion is viewed in cross section, in acute angled relationship with the outer side wall, and a narrow-width backing surface spaced from the pad portion between the inner and outer side wall surfaces of the protruding back-up tooling portion, such backing surface extending about the periphery of the endwall panel at a location contiguous to the chuck wall.

2. The scoring apparatus according to claim 1 wherein the acute-angled relationship between such protruding back-up tool inner and outer side wall surfaces is about 30°.

3. Tooling for forming a peripheral scoreline on a designated product side of a non-circular sheet metal endwall panel of a convenience-feature end closure structure for a non-circular can body to provide for unobstructed removal of solid-pack contents from such can body, comprising:

backing tooling presenting an outer periphery surface having a non-circular shape with dimensional characteristics so as to conform to that of a chuck wall, of the end closure structure, which circumscribes the endwall panel during scoring of the endwall panel, the backing tooling further including an inner periphery surface extending in acute-angled relationship toward such outer periphery surface of the backing tooling, the inner and outer surfaces of the backing tooling extending toward each other for joinder to form a relatively narrow-width rounded-edge backing surface for confronting a designated public side of the endwall panel about its periphery contiguous to such chuck wall during scoring, and scoring tooling disposed in axial alignment with the backing tooling for relative movement therebetween, the scoring tooling including a scoring knife edge in axial alignment with and extending toward the relatively narrow-width backing surface for forming a peripheral scoreline contiguous to the chuck wall in the product side of the endwall panel for unobstructed removal of solid-pack contents of the can body.

* * * * *